United States Patent [19]

Dahm

[11] Patent Number: 4,784,505

[45] Date of Patent: Nov. 15, 1988

[54] CONTAINER WITH STRIPPER

[76] Inventor: Klaus-Peter Dahm, Lehnhast 48, 3052 Bad Nenndorf, Fed. Rep. of Germany

[21] Appl. No.: 268,191

[22] Filed: May 29, 1981

[30] Foreign Application Priority Data

Aug. 28, 1980 [DE] Fed. Rep. of Germany ..... 3032409

[51] Int. Cl.[4] ..... A45D 34/00; A45D 40/26

[52] U.S. Cl. ..... 401/122; 401/129

[58] Field of Search ..... 132/88.5, 88.7; 401/121-124, 129

[56] References Cited

U.S. PATENT DOCUMENTS

| | | | |
|---|---|---|---|
| 599,461 | 2/1898 | Thomas | 401/122 |
| 3,662,769 | 5/1972 | Vasas | 401/122 |
| 3,896,823 | 7/1975 | Spatz | 132/88.7 |
| 3,930,280 | 1/1976 | Vasas | 401/122 |
| 3,951,157 | 4/1976 | Idec | 132/88.7 |
| 4,194,848 | 3/1980 | Kingsord | 401/122 |
| 4,241,743 | 12/1980 | Schnabel | 132/88.7 |

FOREIGN PATENT DOCUMENTS

| | | | |
|---|---|---|---|
| 2285101 | 9/1974 | France | 132/88.5 |

*Primary Examiner*—Steven A. Bratlie

*Attorney, Agent, or Firm*—Marmorek, Guttman & Rubenstein

[57] ABSTRACT

A dispenser adapted to apply a liquid to an object includes a container and a closure for the same. An applicator connected to the closure is normally disposed in the container, and includes a rod which has a predetermined maximum outside diameter along a bottom portion, and a predetermined diameter smaller than the maximum diameter along an upper portion; it is normally positioned upright in the container. An end portion for receiving and dispensing the liquid is connected to the bottom portion of the rod. A stripper is disposed in the container, and has a central opening of a prearranged internal diameter and internal contour, for removing any liquids from the bottom portion of the rod; the rod passes through the opening in a first position of the applicator, where its end portion is adapted to dip into the liquid. The maximum outside diameter of the rod is at least equal to the internal diameter of the opening in the stripper, so as to facilitate removal of the liquid from the bottom portion of the rod; the upper portion of the rod then remains free of any contact with the internal contour of the stripper upon removal of the applicator from the container.

5 Claims, 1 Drawing Sheet

CONTAINER WITH STRIPPER

BACKGROUND OF THE INVENTION

From the German laid-open specification Nos. 27 22 232 and 27 37 667 there are known containers including dispenser elements for applying fluid cosmetic preparations, which are disposed at respective ends of cylindrical or slightly conical shafts. The shafts are formed partially with grooves of different respective cross-sections extending in different respective directions. The containers, in which the fluid substance to be applied is disposed, are provided with stripping elements, for stripping excessive fluid from the dispensing elements, and which are also intended to keep the shafts of respective dispensing elements clean. It has been shown however, that the implementations disclosed in the aforedescribed specification do not attain the objects which they are intended to solve satisfactorily.

An implementation similar to the aforedescribed versions is taught in U.S. Pat. No. 3,160,765. The stripper lips shown therein are enable to keep the shaft of the applicator clean. During use the stripper is completely smeared with the substance to be applied, and reapplies the same to the shaft of the applicator, when the applicator is returned into the container. This shortcoming also applies to the subject to U.S. Pat. No. 3,195,545. The sealing element is smeared during use, and cannot keep the shaft of the applicator clean.

U.S. Pat. No. 3,892,248 shows a bottle-shaped container with a cosmetic substance, and a closure cup threadable onto the container, to which there is secured the shaft of the applicator.

A stripper inserted in the opening of the bottle is formed in such a manner that it raises the applicator, so as to retain any excess fluid. The shaft of the applicator is not, however engaged, so that it is continuously wetted by the fluid disposed in the container. In liquids capable of forming drops the liquid during use flows towards the applicator, and therefore at least partially nullifies the affect of the stripper engaging the applicator. A satisfactory dosage and clean maintenance of the shaft is not possible, even in this implementation. For this reason most manufacturers of containers, which are filled with fluid substances or substances which can form drops, limit themselves to the insertion of a protective device at the outlet of the opening of the container. These do not have any direct contact with the shaft or applicator element either. An excessive dosis of the substance to applied had up till now to be stripped off at the neck of the bottle. When using liquids with volatile solvents this led to a rapid gluing of the opening of the bottle, and to the gluing of the closure to the container. Furthermore a part of the rapidly thickening material drops back into the bottle, and causes there a gradual thickening of the substance. This leads to considerable material losses. Particularly in the case of fingernail polishes handling with only one hand is desired. The shaft with the applicator on one end thereof must be easily removable from the bottle. For this reason an increased stripping action, by pressing the stripper at a higher pressure to the shaft of the applicator, is not possible. The necessary friction forces arising between the stripper and the shaft of the applicator would lead to a lifting of the entire bottle. In order to obtain a suitable proportioning of a fingernail polish, it has been attempted to manufacture it at a relatively high viscosity, which, however impaired its applicability. Furthermore the problem of the rapid drying has not been solved thereby.

SUMMARY OF THE INVENTION

It is one of the principal objects of the invention, to create a combination of the aforedescribed kind, so that in addition to an effective dosage of the substance removed by the applicator, the applicator shaft is maintained clean during use.

This object is attained by the outer diameter of the shaft being dimensioned over almost its entire length to be at least equal to the inner diameter of the stripper, so that an easy stripping effect is attained, and by the shaft having an upper portion near to, and facing away from the liquid-receiving and liquid-dispensing portion, having a small diameter, so that it cannot be engaged or make contact with the internal contour of the opening in the stripper. This region is advantageously at least as long as the thread of the closure cap. By this means the stripper does not engage the shaft or rod, even when the closure cap is loosely connected to the bottle. It is particularly advantageous if the stripper has a slight pretension, so that it encloses the rod during removal of the applicator, and its liquid-dispensing and liquid-receiving portion, from the bottle. This is made possible by a diameter of the rod being slightly larger than the inner diameter of the stripper.

The stripper is advantageously made of elastic plastic material, which ensures that any thickened material is peeled off, when the bottom is closed by the closure cap.

The dispenser ensures that a desired dosage of the liquid adheres thereto, which is to be applied to an object, when the applicator is removed from the bottle. First the rod of the applicator element, or the applicator, is stripped from top to bottom. Any liquid adhering to the portion of the rod having a smaller diameter, for example nail polish, is caused to flow back towards the larger diameter of the rod by the stripper, following a further removal of the liquid. Following closure of the bottle any remnant adhering to any upper region of the rod flows unhindered towards the bottom of the bottle. The section of the rod having the small diameter may be advantageously disposed sufficiently interiorly of the closure cap, so that a contact with the fingernails during use is practically impossible. Losses which have occurred so far by stripping off any excess material at the rim of the container are reduced to a negligible proportion.

BRIEF DESCRIPTION OF THE DRAWINGS

For a fuller understanding of the nature and objects of the invention, reference should be had to the following detailed description, taken in connection with the accompanying drawings in which:

FIG. 1 is a container, according to the present invention, in elevational cross-section with the cap threaded on.

DESCRIPTION OF THE PREFERRED EMBODIMENTS

Figure 1:
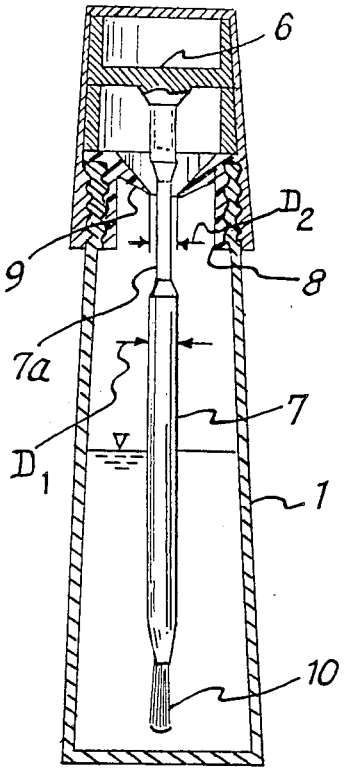
Figure 2:
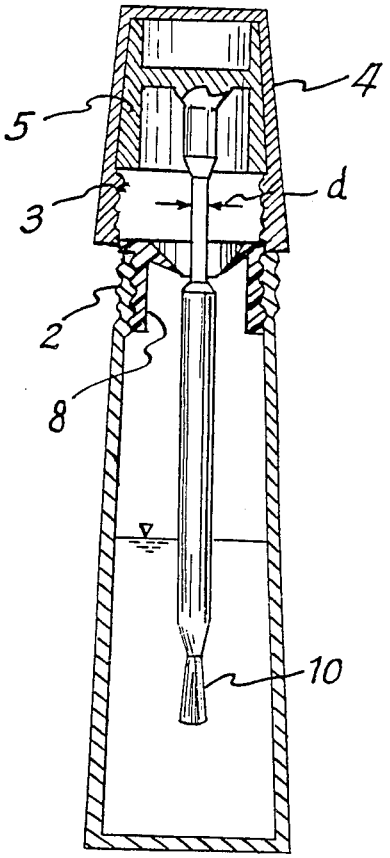
FIG. 2 corresponds to FIG. 1 except that the closure cap has been unthreaded from the bottle.

A container, such as a bottle 1 is provided near its upper end with engaging means, such as a thread 2, which engages an inner thread 3 of a closure cap 4. A sleeve 5 is pressed into the closure cap 4 and is provided with a cross piece 6, threaded also, if necessary, to which there is secured the near and portion of a rod or shaft 7 with a free end portion that carries, near its tip, receiving means 10 operable for receiving and dispensing the liquid. The rod 7 has an intermediate portion or upper region *7a* having a diameter d. Over its major lower portion the rod 7 has a maximum diameter $D_1$, which is greater than the diameter d.

A stripper 8 having a central opening of a diameter $D_2$ is threaded into the opening of the container, so as to form stripping lips 9. The diameter $D_2$ of the central opening of the stripper 8 corresponds approximately to the diameter $D_1$ of the rod 7, so that the rod 7 may be easily removed through the central opening of the stripper 8, with the lips 9 of the stripper retaining their stripping action. The lips advantageously point downwardly, so that the stripping action is improved by shearing off of any dried liquid film remaining on the rod 7. The region *7a* having a diameter d is not, however, engaged by the stripping lips, either when the container is closed by the cap 4 being theaded thereon, or if the cap 4 loosely sits on the bottle 1. The rod 7 is formed with a converging conical end at its lower portion. This results in a follow-up flow of the liquid from that conical end, and which is finally received by the receiving means 10, operable for receiving and dispensing the liquid.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. A dispenser, adapted to apply a liquid to an object, comprising in combination, a container for a liquid, a closure for said container, and an applicator connected to said closure and normally disposed in said container, said applicator including a rod comprising a near end portion connected to said closure, a free end portion of predetermined maximum outside diameter, and between said end portions an intermediate portion of a certain length and of reduced diameter smaller than said maximum outside diameter, said free end portion including, near the tip, means for receiving and dispensing said liquid, said applicator being movable in opposite longitudinal directions to and from a rest position wherein said rod is normally positioned uprightly in said container and at least said receiving and dispensing means is adapted to dip into the liquid, a stripper secured in said container and having a central opening of an internal diameter, said maximum outside diameter of said rod being at least equal to said internal diameter of said opening in said stripper, and the reduced diameter of said rod being smaller than said internal diameter of said opening, and engaging means between said container and said closure for selectively engaging said closure to said container and, respectively, disengaging said closure from said container by relative movement therebetween in said longitudinal directions throughout a predetermined distance, said certain length of said intermediate portion of reduced diameter being at least equal to said predetermined distance, whereby there will be facilitated removal by said stripper of any liquid from the free end portion of maximum diameter of said rod, while the intermediate portion of reduced diameter of said rod will remain substantially free of any contact with the internal contour of said stripper during removal of said applicator from said rest position.

2. A dispenser as claimed in claim 1, wherein said internal diameter of said opening is normally smaller than said maximum diameter of said rod, whereby said stripper surrounds the bottom portion of the rod of said applicator with a slight pretension during removal of the applicator from said container.

3. A dispenser as claimed in claim 1, wherein said stripper is made of elastic plastic material.

4. A dispenser as claimed in claim 1, wherein a portion of said rod near said tip converges in a direction facing from said closure.

5. A dispenser as claimed in claim 1, wherein said intermediate portion of said rod extends for a predetermined length below said opening, and for a prearranged length above said opening when said applicator is disposed in its normal position in said container.

* * * * *